US008523237B2

(12) United States Patent
Sekine et al.

(10) Patent No.: US 8,523,237 B2
(45) Date of Patent: Sep. 3, 2013

(54) REFLECTION PATTERN-PRINTED TRANSPARENT SHEET

(75) Inventors: Keiko Sekine, Chiba (JP); Yuichi Miyazaki, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 532 days.

(21) Appl. No.: 12/073,789

(22) Filed: Mar. 10, 2008

(65) Prior Publication Data

US 2008/0252064 A1 Oct. 16, 2008

(30) Foreign Application Priority Data

Mar. 12, 2007 (JP) ..... 2007-061426

(51) Int. Cl.
*B42D 1/00* (2006.01)
*B42D 15/10* (2006.01)

(52) U.S. Cl.
USPC ..... 283/91; 281/2; 283/72; 283/92; 283/901

(58) Field of Classification Search
USPC ..... 281/2, 51; 283/72, 91, 117, 901, 283/67, 92
See application file for complete search history.

(56) References Cited

U.S. PATENT DOCUMENTS

| | | | | |
|---|---|---|---|---|
| 4,410,570 | A | 10/1983 | Kreuzer et al. | |
| 4,710,617 | A * | 12/1987 | Mouchotte | 283/67 |
| 5,560,864 | A | 10/1996 | Goulding | |
| 5,780,629 | A | 7/1998 | Etzbach et al. | |
| 5,798,147 | A | 8/1998 | Beck et al. | |
| 6,136,225 | A | 10/2000 | Meyer et al. | |
| 6,537,624 | B1 | 3/2003 | Suzuki et al. | |
| 2006/0249951 | A1 * | 11/2006 | Cruikshank et al. | 283/92 |
| 2007/0085334 | A1 * | 4/2007 | Watanabe et al. | 283/72 |
| 2009/0176037 | A1 * | 7/2009 | Otoshi et al. | 428/1.1 |

FOREIGN PATENT DOCUMENTS

| | | | |
|---|---|---|---|
| JP | 57-165480 | A | 10/1982 |
| JP | 7-258638 | A | 10/1995 |
| JP | 9-133810 | A | 5/1997 |
| JP | 9-506088 | A | 6/1997 |
| JP | 10-508882 | A | 9/1998 |
| JP | 11-293252 | A | 10/1999 |
| JP | 11-315146 | A | 11/1999 |
| JP | 11-513019 | A | 11/1999 |
| JP | 2001-005684 | A | 1/2001 |
| JP | 2001-042711 | A | 2/2001 |
| JP | 2001-110045 | A | 4/2001 |
| JP | 2001-243006 | A | 9/2001 |
| JP | 2001-262144 | A | 9/2001 |
| JP | 2003-256137 | A | 9/2003 |
| JP | 2005-107296 | A | 4/2005 |
| JP | 2005-112945 | A | 4/2005 |
| JP | 2006-154865 | A | 6/2006 |
| WO | WO 99/34242 | A | 7/1999 |

* cited by examiner

*Primary Examiner* — Dana Ross
*Assistant Examiner* — Justin V Lewis
(74) *Attorney, Agent, or Firm* — Smith Patent Office

(57) ABSTRACT

Provided is a reflected pattern-printed transparent sheet in which a high reflection intensity of a non-visible light is obtained and in which a transparency in a visible light region is high. The above transparent sheet is a reflected pattern-printed transparent sheet in which non-visible light reflective transparent patterns are printed on a surface of a transparent substrate and which is mounted oppositely to a front face of a medium capable of displaying images, wherein an ink forming the transparent patterns described above contains a non-visible light reflection material; the non-visible light reflection material is a material having a wavelength selection reflectivity to a wavelength in a non-visible light region; and a thickness of the above transparent patterns is 6 to 20 μm.

11 Claims, 4 Drawing Sheets

REFLECTION PATTERN-PRINTED TRANSPARENT SHEET

BACKGROUND OF THE INVENTION

1. Field of the Invention

The present invention relates to a reflected pattern-printed transparent sheet which is a member capable of being applied to a data input system inputting onto a picture plane of a medium, having a light weight and a low price, easily increased in an area and providing a coordinate (position information) detect means capable of being produced in a large quantity and in which a strong reflected light is obtained.

2. Related Art

In recent years, increased is necessity to convert handwritten characters, pictures, marks and the like to electronic data which can be handled by information processing devices, and in particular, increased is demand to systems in which handwritten informations are input into a computer and the like in real time without passing through a read device such as a scanner and the like.

In order to meet the above situations, it is consider to combine, for example, an electronic pen with a matter on which patterns reflecting a non-visible light are printed as position information showing positions of input lines.

Disclosed in, for example, a patent document 1, is a transparent sheet which is mounted on a front face or a front side of a display device and on which marks capable of providing position informations for showing the positions of input lines by an electronic pen for input and the like are printed by using an ink emitting light capable of being read by the above input line read means by irradiating with light having a prescribed wavelength.

Further, a coordinate input device prepared by using a transparent member on which a specific ink reflecting light in an infrared region is printed is disclosed in a patent document 2.

However, the examples of specific transparent sheets are not shown in the patent documents 1 and 2, and only an idea or a desire of a transparent sheet is described therein.

On the other hand, disclosed in patent documents 3 and 4 are diffraction gratings comprising a color filter of LCD using a cholesteric liquid crystal layer or a liquid crystalline film in which diffraction patterns are transferred on a chiral smectic C liquid crystal layer, circularly polarized plates, optical filters and the like.

However, in the techniques disclosed in the above documents, it is not indicated to make use of the above liquid crystal layers for dot-like patterns for detecting coordinates. The above liquid crystal layers are thin, and when it is assumed to read them by means of a pen type sensor which reflects an infrared ray and detects a reflected light thereof in the form of an image, it has been difficult to obtain an intense reflected light.

Accordingly, a reflected pattern-printed transparent sheet having a high reflection intensity of an infrared ray or a UV ray is desired.

Patent document 1: Japanese Patent Application Laid-Open No. 256137/2003

Patent document 2: Japanese Patent Application Laid-Open No. 243006/2001

Patent document 3: International Patent Publication WO99/034242 pamphlet

Patent document 4: Japanese Patent Application Laid-Open No. 154865/2006

SUMMARY OF THE INVENTION

The present invention has been made in order to solve the problems described above, and an object of the present invention is to provide a reflected pattern-printed transparent sheet in which a high reflection intensity of a non-visible light is obtained and in which a transparency in a visible light region is high.

Intensive researches repeated by the present inventors in order to achieve the object described above have resulted in achieving the object by increasing a thickness of the transparent patterns in a transparent sheet in which non-visible light reflective transparent patterns are printed on a surface of a transparent substrate and which is mounted on a medium capable of displaying images, and thus the present invention has been completed.

That is, the present invention provides a reflected pattern-printed transparent sheet in which non-visible light reflective transparent patterns are printed on a surface of a transparent substrate and which is mounted oppositely to a front face of a medium capable of displaying images, wherein an ink forming the transparent patterns described above contains a non-visible light reflection material; the non-visible light reflection material is a material having a wavelength selection reflectivity to a wavelength in a non-visible light region; and a thickness of the above transparent patterns is 6 to 20 μm.

According to the present invention, a reflected pattern-printed transparent sheet in which a high reflection intensity of a non-visible light is obtained and in which a transparency in a visible light region is high can be provided.

EXPLANATIONS OF THE CODES

Figure 1:
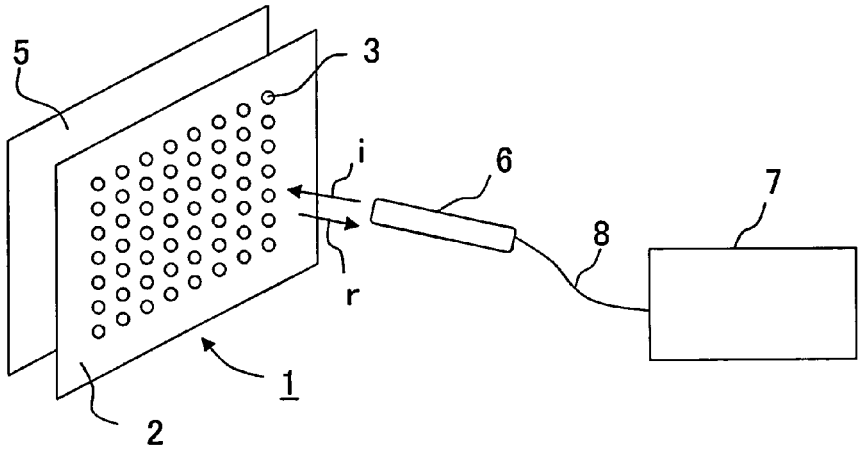
FIG. 1 is a schematic drawing of a whole system using the reflected pattern-printed transparent sheet of the present invention.

1: Reflected pattern-printed transparent sheet (transparent sheet)
2: Transparent substrate
21: Base material
22: Primer layer
23: Aligned film
3: Transparent patterns
5: Medium
6: Input terminal (pen type)
7: Read data processing device
8: Cord
i: Infrared ray or UV ray
r: Reflected light

BEST MODE FOR CARRYING OUT THE INVENTION

Figure 2:
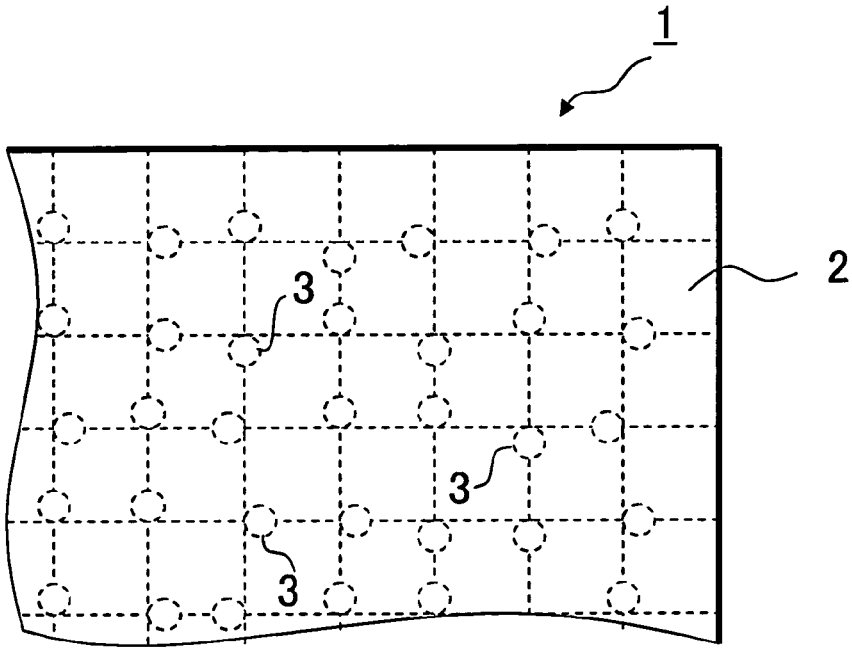
FIG. 2 is an enlarged substantial part of a plain drawing showing an example in which dot patterns are irregularly arranged in the reflected pattern-printed transparent sheet of the present invention.
Figure 3:
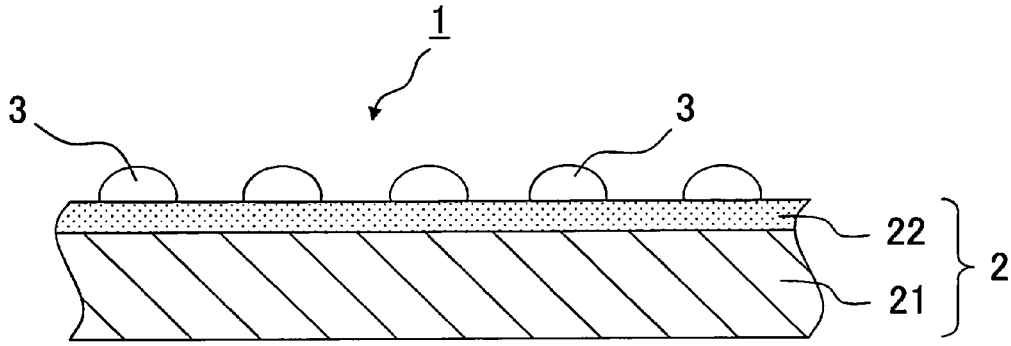
FIG. 3 is a cross section showing one embodiment of the reflected pattern-printed transparent sheet of the present invention.
Figure 4:
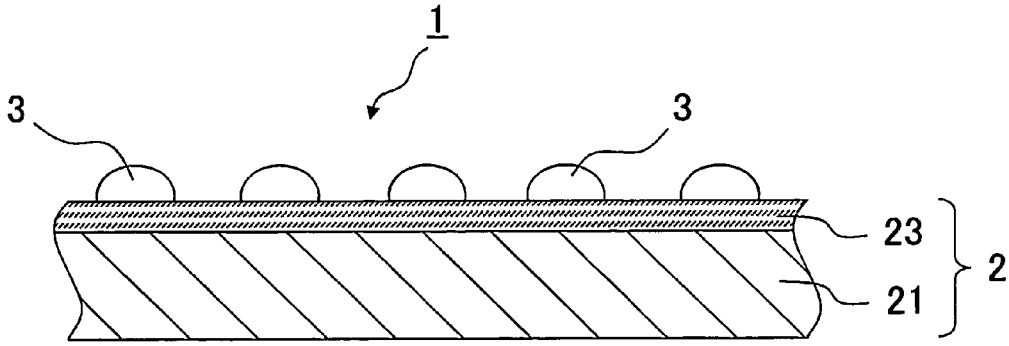
FIG. 4 is a cross section showing another embodiment of the reflected pattern-printed transparent sheet of the present invention.

The present invention shall be explained below with reference to the drawings. FIG. 1 is a schematic drawing of a whole system using the reflected pattern-printed transparent sheet of the present invention. FIG. 2 is an enlarged substantial part of a plain drawing showing an example in which dot patterns are arranged in a specific regularity corresponding to a coordinate in the reflected pattern-printed transparent sheet of the present invention. FIG. 3 is a cross section showing one embodiment of the reflected pattern-printed transparent sheet of the present invention. FIG. 4 is a cross section showing another embodiment of the reflected pattern-printed transparent sheet of the present invention.

The reflected pattern-printed transparent sheet 1 (hereinafter referred to merely as the transparent sheet 1) of the present invention is a sheet in which non-visible light reflective transparent patterns 3 are printed on a surface of a transparent substrate 2 as shown in FIGS. 1 to 2 and which is mounted oppositely to a front face of a medium 5, for example, a display unit capable of displaying images, wherein an ink constituting the transparent patterns 3 contains a non-visible light reflection material; the non-visible light reflection material described above is a material having a wavelength selection reflectivity to a wavelength in a non-visible light region; and a thickness of the above transparent patterns is 6 to 20 μm. In this regard, the medium 5 may be any one as long as it may not be a display unit.

If a thickness of the transparent patterns is 6 μm or more, the reflection intensity is increased, and on the other hand, if it exceeds 20 μm, a disturbance in an aligning property of the liquid crystal, it results in bringing about a reduction in the transparency and an increase in the dry load. The thickness is preferably 8 to 20 μm.

The non-visible light used in the present invention is preferably an infrared ray or a UV ray, more preferably a near infrared ray or a near UV ray.

Various methods are available in order to increase a thickness of the non-visible light reflective transparent patterns 3 (hereinafter referred to merely as the transparent patterns 3).

For example, it includes, as shown in FIG. 3, a case in which a transparent substrate 2 comprises a base material 2 and a primer layer 22 and in which transparent patterns 3 are printed on the surface of the primer layer 22, wherein a contact angle formed by a liquid ink forming the transparent patterns 3 and the primer layer 22 is increased.

Further, a viscosity of the ink described above and an amount of a solid matter contained therein may be increased; a solvent having a relatively low boiling point may be selected; and an area of the individual transparent patterns 3 may be enlarged so that the ink stands up more.

In particular, a primer composition constituting the primer layer 22 is preferably blended with a liquid repellent leveling agent, whereby the primer layer 22 repels the ink described above to thereby allow the transparent patterns 3 to stand up, and the printed thickness is preferably increased.

The transparent patterns 3 used in the present invention reflect preferably either of a left circularly polarized light component and a right circularly polarized light component in an incident light (the above property is referred to as a circularly polarized light selection reflectivity. The components of the ink forming the transparent patterns 3 reflect preferably a non-visible light and transmit a preferably visible light (the above property is referred to as a circularly polarized light selection reflectivity). Further, the transparent patterns 3 read preferably reflected patterns of the non-visible light by means of an input terminal capable of irradiating and detecting the non-visible light to make it possible to provide the position informations of the input terminal on the transparent sheet.

Further, when a cross section obtained by cutting the formed transparent patterns 3 in a face orthogonal to the transparent substrate 2 is observed under a scanning electron microscope, the transparent patterns 3 are preferably formed so that they comprise a multilayer structure comprising a fixed repeating cycle. The multilayer structure described above is more preferably formed from a liquid crystal material having a fixed cholesteric structure.

In this regard, in a liquid crystal having a levorotary or dextrorotary cholesteric (chiral nematic) structure, an axis of each liquid crystal molecule is present in each layer face of the multilayer structure, and it is oriented uniformly along a specific direction in the above layer face. In addition thereto, an orientation direction of the above liquid crystal molecule axis is changed in order as a function of a layer thickness direction, and it is rotated in order as it proceeds to a thickness direction of the above cholesteric structure. As a result thereof, the rotation axis is turned to a thickness direction of the above multilayer film, and it assumes a helical structure (cholesteric structure) of a certain cycle which is rotated to a specific direction in a layer face of the above multilayer film. The circularly polarized light selection reflectivity that only a circularly polarized light component in which a rotation direction of the above spiral is agreed with a rotation direction of the electric field is reflected is shown as the characteristic of the cholesteric structure, and it has the wavelength selection reflectivity that a circularly polarized light of a wavelength corresponding to the above helical pitch is reflected. Accordingly, it is suited to the uses of the present invention. It has the property (selection reflectivity) that it reflects a circularly polarized light of a wavelength corresponding to the direction and the helical pitch. In general, a selective reflection wavelength λ (nm) is given by the following equation:

$$\lambda = p \cdot n \cdot \cos\theta$$

p: helical pitch (nm) of cholesteric liquid crystal
n: average refractive index of liquid crystal
θ: incident angle of light (angle measured from a normal line on the surface)

Figure 5:
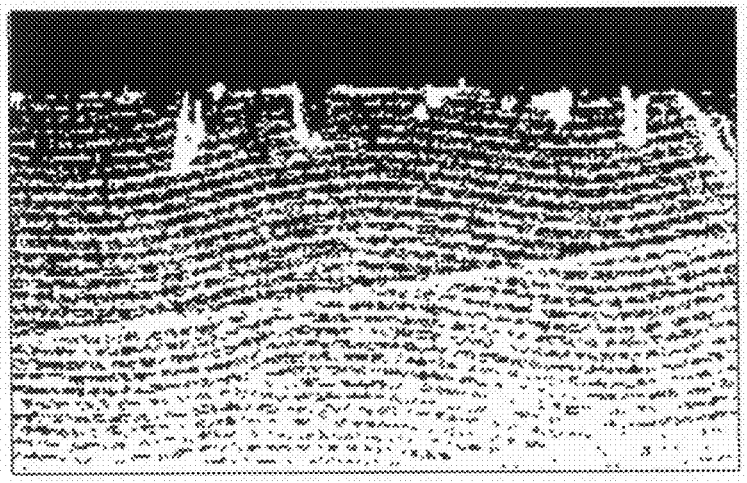
FIG. 5 is a scanning electron micrograph showing a repetitive layer structure of a cholesteric liquid crystal.

One pitch of a cholesteric structure is a length of an axis observed when a long and narrow liquid crystal molecule rotates by 360° in a helical form, and actual observation of the cross section reveals a repetitive layer structure in every rotation of 180° (refer to FIG. 5). Accordingly, an apparent interlayer pitch found in observing the cross section is ½ of a helical pitch of the liquid crystal, and if an apparent interlayer pitch found in observing the cross section is, for example, 250 nm, a pitch of the liquid crystal is 500 nm.

When a circularly polarized light comes in, reversed is a rotational direction in a circularly polarized light component of light reflected on the surface of a transparent substrate comprising a material such as a resin, glass and the like which is usually used as a substrate. On the other hand, a rotational direction in a circularly polarized light component of light reflected on the surface of a cholesteric liquid crystal is as it is and unchanged. Accordingly, making use of the above property makes it possible to improve an SN ratio of light reflected from an infrared ray reflective transparent pattern to a background light (light reflected from other parts than the pattern part) by combining with a circular polarization filter.

In general, ⌈liquid crystal⌋ refers to a liquid crystal staying in a state showing a fluidity in a narrow sense, but in the specification of the present invention, a liquid crystal material having a fluidity which is solidified by means such as cross-linking, cooling and the like in the state that desired performances such as optical characteristics, a refractive index, an anisotropy and the like each owned by liquid crystals are maintained and which is turned into a non-fluid state shall be called as well ⌈liquid crystal⌋.

The liquid crystal material having a cholesteric structure contained in the transparent ink which is suitably used for the transparent sheet 1 of the present invention shall be explained below. In the present invention, a wavelength of a non-visible light shall not specifically be restricted. Among non-visible lights, usually a ray in a near infrared region of particularly 800 to 2500 nm is preferably used in an infrared ray, and usually a ray in a near UV region of particularly 200 to 400 nm is preferably used in a UV ray.

In the following, explanations shall be given with a focus put on a near infrared region of 800 to 2500 nm and a near UV region of 200 to 400 nm. In this connection, a visible light referred to in the present application resides in a wavelength region capable of visually observing and has a wavelength of 380 to 780 nm. Transparency means that a light transmittance in the above visible light wavelength region is high, to be specific, a light transmittance in the above visible light wavelength region is about 50% or more, preferably 70% or more.

The non-visible light reflection material constituting the transparent patterns 3 used in the present invention is preferably a liquid crystal material showing a cholesteric liquid crystal phase having a cholesteric regularity, and polymerizable chiral nematic liquid crystal materials (polymerizable monomer or polymerizable oligomer) or high molecular cholesteric liquid crystal materials prepared by mixing polymerizable nematic liquid crystals having a cross-linkable functional group with a polymerizable chiral agent having a cross-linkable functional group can suitably be used. The above polymerizable chiral nematic liquid crystal materials are polymerized and solidified (cured) by bringing about cross-linking reaction and the like by a publicly known method such as irradiation with an ionizing radiation including a UV ray, an electron beam and the like or heating.

In the present invention, among the polymerizable liquid crystal materials described above, cross-linkable polymerizable monomers or polymerizable oligomers each having a cross-linkable functional group are preferably used, and they have more preferably an acrylate structure as a polymerizable functional group.

In the case of the liquid crystal materials assuming (developing) the cholesteric structure described above, a high transmittance is not necessarily required in a wavelength of a visible ray region as long as they show a high reflectance (usually about 5 to 50% to a non-polarized light) in at least a part of a wavelength of a non-visible light region. This is because assuming that the polymerizable liquid crystal materials having the cholesteric structure described above are completely opaque, a desired transparency can be obtained in the whole part of the transparent patterns concerned if an area of a non-forming part (margin part) in the above liquid crystal materials is taken to a suitably large extent to make use of a light transmitting through the above part. However, it is a matter of course that a visible light transmittance of the above liquid crystal materials is preferably higher. Usually, if a high reflection wavelength area of the above polymerizable liquid crystal materials assuming a cholesteric structure is set to an infrared region, a visible light transmittance of about 70% or more is obtained in a thickness of about several μm in a visible ray region. On the other hand, a high reflectance of about 5 to 50% to a non-polarized light is usually obtained in a non-visible light region. Also, a temperature range in which the polymerizable liquid crystal materials described above assume a cholesteric structure shall not specifically be restricted, and it can preferably be fixed in the state of a cholesteric phase by cross-linking. The materials in which a temperature allowing the materials to assume a cholesteric phase falls in a range of 30 to 140° C. are preferred since a drying step in printing the patterns and a phase transition of the liquid crystal can be carried out at the same time.

Such materials as described above can be optically fixed while allowing liquid crystal molecules to stay in a state of a cholesteric liquid crystal, and the patterns which are easily handled as the transparent sheet 1 and which are stable at ambient temperature can be formed.

Further, capable of being used as well are liquid crystal polymers (high molecular cholesteric liquid crystals) which have a high glass transition temperature and which can be solidified in a glass state at ambient temperature by cooing after heating. The above materials can be optically fixed as well while allowing liquid crystal molecules to stay in a state of a liquid crystal having a cholesteric regularity, and patterns which are easily handled as an optical sheet and which are stable at ambient temperature can be formed.

Mixtures of liquid crystalline monomers and chiral compounds disclosed in Japanese Patent Application Laid-Open No. 258638/1995, Japanese Patent Application Laid-Open (through PCT) No. 513019/1999, Japanese Patent Application Laid-Open (through PCT) No. 506088/1997 and Japanese Patent Application Laid-Open (through PCT) No. 508882/1998 can be used as the cross-linkable polymerizable monomers described above. For example, a chiral nematic liquid crystal (cholesteric liquid crystal) is obtained by adding a chiral agent to a liquid crystalline monomer showing a nematic liquid crystal phase. Processes for producing films of cholesteric liquid crystals are described as well in Japanese Patent Application Laid-Open No. 5684/2001 and Japanese Patent Application Laid-Open No. 110045/2001.

The nematic liquid crystal molecules (liquid crystalline monomers) which can be used in the present invention include, for example, compounds represented by Formulas (1) to (11) shown below. The compounds shown below as examples have an acrylate structure and can be polymerized by irradiating with a UV ray and the like.

(1)

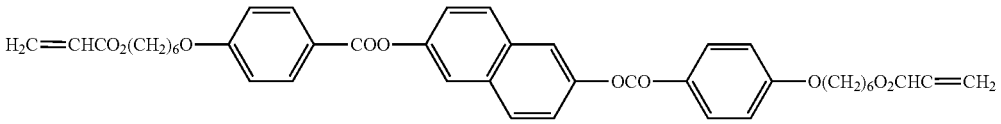

(2)

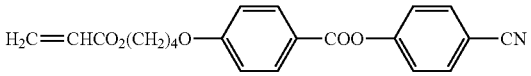

(3)

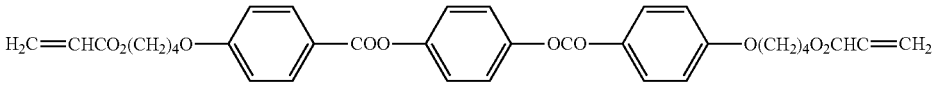

-continued (4)

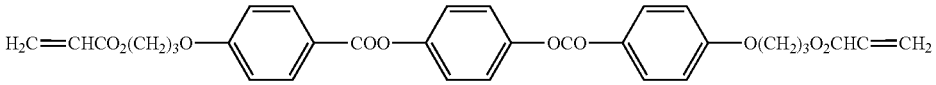

(5)

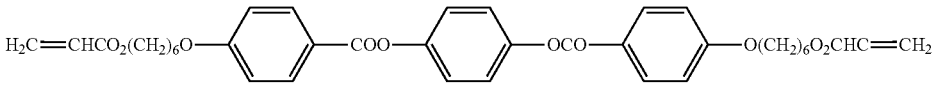

(6)

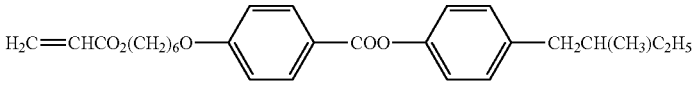

(7)

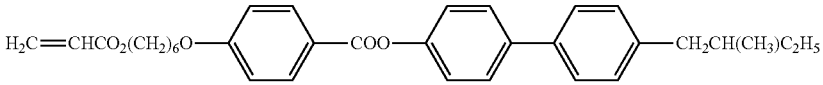

(8)

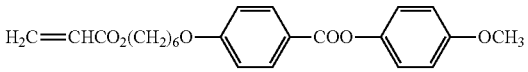

(9)

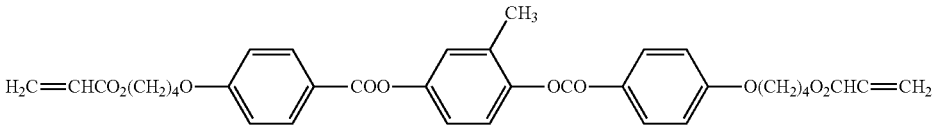

(10)

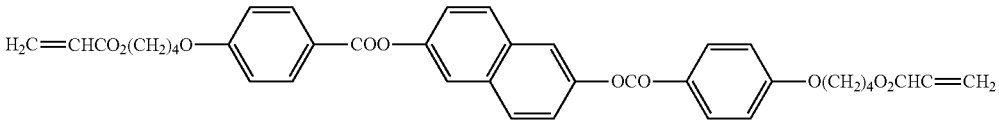

(11)

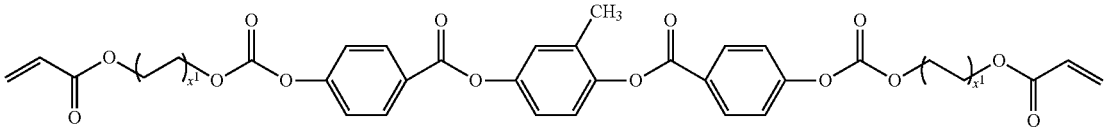

In Compound (11), $X^1$ is 2 to 5 (integer).

Also, cyclic organopolysiloxane compounds having a cholesteric phase disclosed in Japanese Patent Application Laid-Open No. 165480/1982 can be used as the cross-linkable polymerizable oligomers described above.

Further, high polymers which assume a liquid crystal and in which a mesogen group is introduced into a position of a principal chain or a side chain or both positions of a principal chain and a side chain, high molecular cholesteric liquid crystals in which a cholesteryl group is introduced into a side chain, liquid crystalline high polymers disclosed in Japanese Patent Application Laid-Open No. 133810/1997 and liquid crystalline high polymers disclosed in Japanese Patent Application Laid-Open No. 293252/1999 can be used as the liquid crystal polymers described above.

The chiral agent contained in the transparent ink used in the present invention is a material which has an asymmetric carbon atom and which forms a chiral nematic phase by mixing with a nematic liquid crystal, and it shall not specifically be restricted as long as it has a polymerizability. A material having an acrylate structure represented by Formula (12) is preferred since it is polymerizable by irradiation with a UV ray.

(12)

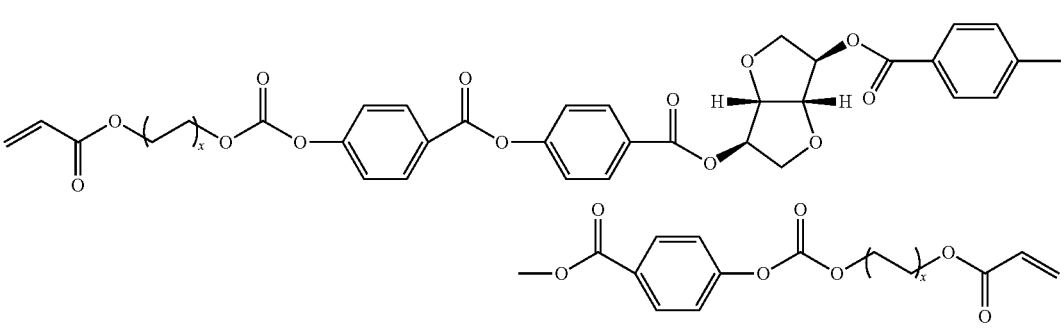

X is 2 to 5 (integer).

The property of reflecting an infrared ray by the transparent patterns in the present invention makes use of, as described above, a wavelength selection reflectivity (the same principle as Bragg reflection in X-ray diffraction) of a liquid crystal material having a cholesteric structure. The selective reflection peak wavelength thereof (wavelength satisfying the Bragg reflection conditions) is determined by a pitch length of a cholesteric structure contained in the patterns, and when the nematic liquid crystal and the chiral agent are used as the liquid crystal material, the pitch length can be controlled by controlling an addition amount of the chiral agent. An addition amount of the chiral agent for obtaining the selective reflection peak wavelength in the targeted infrared region is varied depending on the kinds of the liquid crystal used and the chiral agent, and when using, for example, the liquid crystal represented by Formula (11) and the chiral agent represented by Formula (12), a cholesteric phase having a reflection peak in an infrared region is formed by adding about 3 parts by weight of the chiral agent to 100 parts by weight of the liquid crystal. When a high molecular cholesteric liquid crystal is used for the liquid crystal material, a polymer material having the targeted pitch length is suitably selected.

The polymer of the nematic liquid crystal molecules and the chiral agent in the present invention is obtained, for example, by adding a publicly known photopolymerization initiator and the like to a polymerizable nematic liquid crystal and a polymerizable chiral agent and irradiating the mixture with a UV ray to radically polymerize it.

The photopolymerization initiator includes photopolymerization initiators such as a bisacylphosphine oxide base and an α-aminoketone base. The specific examples of the bisacylphosphine oxide base photopolymerization initiator include diphenyl-(2,4,6-trimethylbenzoyl)phosphine oxide, bis(2,4,6-trimethylbenzoyl)phenylphosphine oxide and the like. The specific examples of the-aminoketone base photopolymerization initiator include 2-methyl-[4-(methylthio) phenyl]-2-morpholinopropane-1-one and the like.

Also, when printing the transparent patterns 3 in the present invention, a coating liquid prepared by dissolving the polymerizable monomer or the polymerizable oligomer and the chiral agent in a solvent is preferably used.

The above solvent shall not specifically be restricted as long as it has a satisfactory solubility to the materials, and publicly known compounds are suitably used. It includes, for example, conventional solvents such as anone (cyclohexanone), cyclopentanone, toluene, acetone, MEK (methyl ethyl ketone), MIBK (methyl isobutyl ketone), DMF (N,N-dimethylformamide), DMA (N,N-dimethylacetamide), methyl acetate, ethyl acetate, n-butyl acetate, 3-methoxybutyl acetate and the like and mixed solvents thereof.

The base material 21 for the transparent substrate 2 used for the reflected pattern-printed transparent sheet 1 of the present invention shall not specifically be restricted as long as it is a material transmitting a visible light, and it is preferably made of a material having less optical defects. So-called films, sheets or materials having a tabular form are suitably used. Further, it may be flat, and in addition thereto, it may have a curved surface form so that it fits a curved surface of a display. To be specific, glass, TAC (triacetyl cellulose), PET (polyethylene terephthalate), polycarbonate, polyvinyl chloride, acryl, polyolefin and the like are suitably used as the materials for the transparent substrate. The thickness thereof is selected from a range of 20 to 5000 μm, preferably 100 to 5000 μm from the viewpoint of the curling property according to the material, the required performances and the use form.

When a material which is liable to be dissolved or swollen in a solvent, such as a high molecular film including a TAC film and the like is used as the base material 21 described above, a barrier layer may be provided on the base material 21 so that the base material is not damaged by a solvent contained in the coating liquid used in printing the transparent patterns. In this case, the barrier layer may double as the orientation layer, and water-soluble materials such as, for example, PVA (polyvinyl alcohol), HEC (hydroxyethyl cellulose) and the like are suitably used for the barrier layer.

A material used for the primer composition constituting the primer layer 22 provided, if necessary, on the base material 21 for the transparent substrate 2 according to the present invention is preferably transparent resins comprising organic resins, inorganic resins and the like particularly in terms of capable of forming a layer by coating. The resins used for the primer layer shall not specifically be restricted and include, for example, thermoplastic resins, thermosetting resins, ionizing radiation-curing resins and the like. Among them, resins of a type in which curing is carried out by cross-linking are preferred from the viewpoint of obtaining a durability, a solvent resistance and a broad read angle, and the ionizing radiation-curing resins which can be cross-linked for short time by an ionizing radiation such as a UV ray, an electron beam and the like are more preferred.

The thermoplastic resin described above includes, for example, acryl resins, polyester resins, thermoplastic urethane resins, vinyl acetate resins, cellulose base resins and the like, and when the material of the transparent substrate is a cellulose base resin such as TAC (triacetyl cellulose) and the like, the thermoplastic resin is preferably the cellulose base resin such as nitrocellulose, acetyl cellulose, cellulose acetate propionate, ethyl hydroxyethyl cellulose and the like.

The thermosetting resin described above includes, for example, phenol resins, urea resins, diallyl phthalate resins, melanin resins, guanamine resins, unsaturated polyester resins, urethane resins, epoxy resins, aminoalkyd resins, melamine-urea copolycondensation resins, silicone resins, polysiloxane resins, curable acryl resins and the like. When the thermosetting resin is used, a cross-linking agent, a curing agent such as a polymerization initiator and the like, a polymerization accelerating agent, a solvent, a viscosity controlling agent and the like can be further added and used if necessary.

The material used for the primer layer is preferably the ionizing radiation-curing resins, and various reactive monomers and/or reactive oligomers are suitably used. The reactive monomers include, for example, multifunctional (meth)acrylates. The reactive oligomers include oligomers having a radically polymerizable unsaturated group in a molecule, for example, epoxy (meth)acrylates, urethane (meth)acrylates, polyester (meth)acrylates, polyether (meth)acrylates and the like. In this connection, (meth)acrylate means acrylate or methacrylate.

A polymerization initiator for the reactive monomers or the reactive oligomers includes the bisacylphosphine oxide base and the α-aminoketone base each described above.

The multifunctional (meth)acrylate monomers include ethylene glycol di(meth)acrylate, propylene glycol di(meth) acrylate, 1,4-butanediol di(meth)acrylate, 1,6-hexanediol di(meth)acrylate, neopentyl glycol di(meth)acrylate, polyethylene glycol di(meth)acrylate, hydroxypivalic acid neopentyl glycol di(meth)acrylate, dicyclopentanyl di(meth) acrylate, caprolactone-modified dicyclopentenyl di(meth) acrylate, ethylene oxide-modified phosphoric acid di(meth) acrylate, allylated cyclohexyl di(meth)acrylate, isocyanurate di(meth)acrylate, trimethylolpropane tri(meth)acrylate, ethylene oxide-modified trimethylolpropane tri(meth)acrylate, dipentaerythritol tri(meth)acrylate, propionic acid-modified dipentaerythritol tri(meth)acrylate, pentaerythritol tri(meth) acrylate, propylene oxide-modified trimethylolpropane tri (meth)acrylate, tris(acryloxyethyl) isocyanurate, propionic acid-modified dipentaerythritol penta(meth)acrylate, dipentaerythritol hexa(meth)acrylate, ethylene oxide-modified dipentaerythritol hexa(meth)acrylate, caprolactone-modified dipentaerythritol hexa(meth)acrylate and the like.

In the present invention, when a means in which a contact angle formed by the primer layer 22 and the above liquid ink for forming the transparent patterns 3 is increased is selected as one of means for achieving, as described above, a thickness of 6 to 20 μm in the transparent patterns 3, the combinations of materials for both are selected so that a contact angle of both is increased. When the satisfactory contact angle is not obtained by both materials themselves, a liquid repellent leveling agent is added to the above primer layer 22. The liquid repellent leveling agent preferably used for the primer composition constituting the above primer layer 22 is preferably materials which repel the ink for forming the transparent patterns 3. Various compounds such as a silicone base, a fluorine base, a polyether base, an acrylic acid copolymer base, a titanate base and the like can be used as the kind of the liquid repellent agent. In order to repel an ink of a liquid crystal material for forming a fixed cholesteric structure, an acrylic acid copolymer base leveling agent (for example, trade name "BYK361", manufactured by BYK Chemie AG.) is preferred. An addition amount thereof is suitably controlled according to a thickness of the transparent patterns 3.

From the viewpoint of not only providing the transparent patterns 3 with a satisfactory thickness but also obtaining the broad read angle, the surface of the transparent patterns may be curved into a convex curved surface (for example, a curved surface such as a semisphere) or fine particles may be added to the primer layer to form irregularities and folds on a Bragg reflection surface having a cholesteric structure of liquid crystal formed thereon in place of or in addition to adding the leveling agent (liquid repellent substance) described above.

Conventionally used substances can be added in a suitable amount as the fine particles without specific restrictions, and they include, for example, spherical particles of α-alumina, silica, kaolinite, iron oxide, diamond, silicon carbide and the like in the case of inorganic particles. The form of the particles includes a sphere, an ellipsoid, a scale and the like, and it shall not specifically be restricted but is preferably a sphere. They include synthetic resin beads of a cross-linked acryl resin, a polycarbonate resin and the like in the case of organic particles. Among them, α-alumina and silica are preferred from the standpoints that they have a high hardness and are very effective for enhancing the abrasion resistance and that spherical particles are liable to be obtained, and the spherical particles thereof are particularly preferred. The fine particles have a particle diameter of 50 μm to 5 mm.

Publicly known various additives and various pigments in coating liquids and inks may suitably be added, if necessary, to the primer layer 22 as long as an infrared reflection function and a moiré preventing effect of the transparent patterns 3 in the present invention are not damaged. The additives include, for example, light stabilizers such as UV absorbers, dispersion stabilizers and the like, and the pigments include, for example, pigments which are publicly known in filters for displays, such as pigments for preventing outside light reflection.

The primer layer can be formed by coating the ink for the primer composition obtained in the manner described above by a publicly known layer forming method such as a coating method, a printing method and the like. To be specific, it is suitably formed on the base material 21 by a coating method such as roll coating, comma coating, die coating and the like or a printing method such as screen printing, gravure printing and the like.

A thickness of the primer layer 22 is usually 1 to 10 μm, and it is preferably 0.1 to 5 μm from the viewpoints of preparing the thinner film and obtaining the broader read angle.

In the reflected pattern-printed transparent sheet of the present invention, an orientation film 23 may be provided, though not necessarily required, on the base material 21 in the transparent substrate 2 in order to stabilize an orientation of liquid crystal when using a liquid crystal material (refer to FIG. 4). A material for the orientation film shall not specifically be restricted, and capable of being used are, for example, publicly known materials for an orientation film such as PI (polyimide), PVA (polyvinyl alcohol), HEC (hydroxyethyl cellulose), PC (polycarbonate), PS (polystyrene), PMMA (polymethyl methacrylate), PE (polyester), PVCi (polyvinyl cinnamate), PVK (polyvinyl carbazole), polysilane containing cinnamoyl, coumarin, chalcone and the like. The orientation film formed by using the above materials may be subjected to rubbing treatment and the like. Further, a resin sheet stretched for an orientation film may be adhered on the transparent substrate.

In the reflected pattern-printed transparent sheet 1 of the present invention, an overcoat layer (surface protect layer comprising a hard coating film) for covering the transparent patterns 3 may be provided on the transparent substrate in order to provide the transparent sheet with a strength which can stand repetitive contact given by an input terminal of a pen type when inputting by handwriting by means of the input terminal. A material of the overcoat layer shall not specifically be restricted, and materials used in the fields of conventional transparent sheets and lenses can be used. Among them, materials having a refractive index which is close to that of the transparent patterns 3 are preferred in order to reduce moiré. The representative materials are, for example, acryl resins, silicone base resins and the like which are cross-linked and cured by a UV ray, an electron beam, heat and the like.

Further, a reflection preventing film and the like may be provided on the surface of the sheet or in the inside thereof in order to secure a visibility of the medium present on the back of the reflected pattern-printed transparent sheet 1 of the present invention. A material of the reflection preventing film shall not specifically be restricted, and materials used in the fields of conventional transparent sheets for displays and lenses can be used. The representative materials are, for example, dielectric multilayer films prepared by laminating a thin film of a substance having a low refractive index such as magnesium fluoride, a fluorine base resin and the like and a thin film of a substance having a high refractive index such as zirconium oxide, titanium oxide and the like so that the above thin film having a low refractive index is provided on the outermost surface.

In the transparent sheet 1 of the present invention, a printing method for the transparent patterns shall not specifically be restricted, and publicly known methods can be used and include, for example, a flexographic printing method, a gravure printing method, a stencil printing method, an ink jet printing method and the like.

The transparent patterns obtained in the manner described above has preferably a selective reflection peak wavelength in 800 to 950 nm or 200 to 400 nm from the viewpoint of enhancing the read accuracy.

In the reflected pattern-printed transparent sheet 1 of the present invention, the transparent patterns 3 are set so that the position informations of an input terminal equipped with a sensor on the sheet face can be derived from the partial patterns read by the input terminal.

Several examples of such patterns are shown in the patent documents 1 and 2 as well and include, for example, patterns obtained by setting plural forms of dots and patternizing combinations of the dots of these plural forms arranged in a prescribed range in a plain face, patterns obtained by changing thicknesses of ruled lines arranged vertically and horizontally and patternizing combinations of sizes of the overlapped parts of the ruled lines described above in a prescribed range and patterns obtained by combining the values of x, y coordinates directly with the vertical and horizontal sizes of dots. Particularly simple and suited patterns include dot patterns obtained by setting standard points arranged vertically and horizontally at equal intervals, disposing dots displaced right and left, up and down based on the above standard points and making use of a relative positional relation from the above standard points. The above method is advantageous for raising a resolution of the input device since a size of the dots can be reduced and fixed.

The dot patterns 3 according to the present invention can suitably be in a thickness when formed by dot printing in which the combination of dots is patternized.

In the reflected pattern-printed transparent sheet of the present invention, a larger non-visible light reflectance in a selective reflection peak wavelength is preferred in order to detect reflected patterns by means of a non-visible light sensor installed in the input device. The reflectance in a selective reflection peak wavelength is usually 5 to 50%, preferably 20% or more. Reflection by a cholesteric structure has a property to reflect only a circularly polarized light having the same direction as that of a cholesteric spiral, and therefore the reflectance reaches only about 50% at a maximum.

When the printed patterns are dot patterns, the dot forms shall not specifically be restricted as long as the dots can readily be distinguished from the adjacent dots, and the forms in which plane-viewing forms are circular, elliptic, polygonal and the like are usually used. A size of the dots in the plain face (evaluated by a diameter in a case of a circle, an average value of a short radius and a long radius in a case of an ellipsoid and a diameter of a circumcircle in a case of a polygon) is about 1 to 200 μm. The steric forms of the dots shall not specifically be restricted as well, and they are usually discoid but may be semispherical and concave.

The medium 5 in which the reflected pattern-printed transparent sheet of the present invention is installed displays various image informations. The image informations displayed may be any forms of still images and moving images. The kinds of the informations is targeted for are various ones such as characters, numbers, figures, decryption codes such as bar codes and the like, photographic images (landscapes, persons, pictures and all the rest) and the like. The specific examples of the medium 5 are CRT (cathode ray tube), LCD (liquid crystal display), PDP (plasma display), EL (electroluminescence) display units and the like. Uses and specifications thereof include various ones (cellular phones and the like) described later. The medium 5 may be connected to information processing devices for processing data input by handwriting or may be independent. The former is preferred since it can show lines input by handwriting on a screen and enables to intuitively input the lines. However, the present invention shall not be restricted to inputting by handwriting, and any inputting methods may be used.

In this regard, the examples which can be shown as the information processing device handling informations input by handwriting or other methods include cellular phones, various mobile terminals such as PDA and the like, personal computers, TV phones, TV endowed with an intercommunication function, internet terminals and the like. Further, books, pamphlets, catalogs, ledger sheets, instruction manuals and the like can be shown as the examples thereof.

An input terminal 6 which can be used in the present invention shall not specifically be restricted as long as it can emits, as shown in FIG. 1, an infrared ray or a UV ray i and detect a reflected ray r of the patterns described above, and publicly known sensors are suitably used. An example in which the input terminal 6 of a pen type is equipped as well with a read data processing device 7 includes an input terminal disclosed in Japanese Patent Application Laid-Open No. 256137/2003, in which built-in are a pen tip provided with no ink and no graphite, a CMOS camera equipped with a non-visible light irradiation part, a processor, a memory, a communication interface such as a wireless transceiver and the like making use of a Bluetooth technique, a battery and the like.

To explain the action of the pen type input terminal 6, the pen tip is brought into contact with a front surface of the transparent sheet 1 on which the dot patterns shown in FIG. 2 are printed and draws lines so that the pen tip traces the front surface, and the pen type input terminal 6 detects a pen pressure applied onto the pen tip to operate the CMOS camera; a prescribed range in the vicinity of the pen tip is irradiated with an infrared ray or a UV ray of a prescribed wavelength emitted from the infrared ray or UV ray irradiation part, and the patterns are imaged (the patterns are imaged several 10 to about 100 times per second). When the pen type input terminal 6 is equipped with a read data processing device 7, input lines formed by movement of the pen tip in handwriting are digitized and turned into data by analyzing the imaged patterns by means of the processor to prepare an input line data, and the input line data is sent to the information processing device.

The members such as the processor, the memory, the communication interface such as a wireless transceiver and the like making use of a Bluetooth technique, the battery and the like may be present, as shown in FIG. 1, as the read data processing device 7 at an outside of the pen type input terminal 6. In this case, the pen type input terminal 6 may be connected to the read data processing device 7 via a cord 8 or may send read data by wireless using an electric wave, an infrared ray, a UV ray and the like.

In addition thereto, the input terminal 6 may be a reader described in Japanese Patent Application Laid-Open No. 243006/2001.

The read data processing device 7 which can be applied in the present invention shall not specifically be restricted as long as it has a function to calculate a position information (corresponding to a coordinate) from a continuous imaged data read by the input terminal 6 and combine it with a time information to provide it as an input line data which can be handled by the information processing device, and it is suitably equipped with the members such as the processor, the memory, the communication interface, the battery and the like.

The read data processing device 7 may be built in the input terminal 6 as described in Japanese Patent Application Laid-Open No. 256137/2003 or may be built in the information processing device equipped with a medium 5. The read data processing device 7 may send a position information to the information processing device equipped with the medium 5 by wireless or may send it by wire connected thereto via a cord and the like.

The read data processing device connected to the medium 5 can display lines input by handwriting by means of the input terminal 6 on the medium 5 in real time (or in suitably delayed time if necessary) as if written on a paper by a pen by renewing sequentially images shown on the medium 5 based on line informations sent from the read data processing device 7.

As described above, the reflected pattern-printed transparent sheet 1 of the present invention provides a high non-visible light reflection intensity but also can be installed as it is in an existing medium, and it can be prepared more readily than position input devices of an electrostatic type, a pressure-sensitive type and the like which are types built in a display device and readily makes it possible to reduce a weight, decrease a cost and increase a size. Further, even when the patterns which can provide the printed position informations are thinned or scratched, so that a function of providing the position informations is reduced, only the transparent sheet can be exchanged, and therefore it is easy for users to handle.

The reflected pattern-printed transparent sheet 1 of the present invention can also be used as a liquid crystal protect sheet by mounting on a liquid crystal display.

The reflected pattern-printed transparent sheet 1 of the present invention can detachably be installed oppositely to the front face of the medium 5. In this regard, the term "installed oppositely to the front face" is a concept including, for example, a case in which the transparent sheet 1 is arranged in direct contact with the surface of the medium 5, a case in which the transparent sheet 1 is adhered thereon via an adhesive layer and a case in which the transparent sheet 1 is arranged in the front of the medium 5 via a space in a non-contact state. The foregoing manner of installation thereof makes it possible to install the transparent sheet not only on one medium but also on another medium. Further, the transparent sheet 1 itself is preferably equipped with a means for installation thereof onto the medium 5 in order to make it possible to install the transparent sheet 1 without subjecting the medium 5 to processing for installing the transparent sheet.

The above installation means may be provided integrally with the transparent sheet 1 or may be provided separately therefrom. The above installation means includes buckle-shaped means which are hooked at the corner parts of the medium 5 and means which pinch the end parts of the medium 5, and when installed oppositely to the front face of the medium 5, the specific embodiment thereof which is simple and suitable includes an adhering instrument which is provided at a contact face side brought into contact with the medium 5 and which has an adhesive property or a sticky property for adhering the instrument onto the medium 5. Further, the adhering instrument includes instruments which are mounted integrally to the transparent sheet 1 and which have an adhesive property and instruments containing an adhesive and the like coated directly on the contact face. Among adhesive properties, particularly the form of an adhesive property in which the adhering instrument can be adhered only by pressing without owing to chemical reaction or supply of energy such as irradiation with a radiation, heat and the like and in which the adhering instrument can be peeled again after adhered is referred to as a pressure-sensitive adhesive property. Further, among adhesives, the form of an adhesive in which an adhesive property is a pressure-sensitive adhesive property is referred to as a pressure-sensitive adhesive.

In the present invention, the medium 5 which is installed is not restricted to a display device for showing images and may be any medium. It may be, for example, paper, plastics, glass and the like. Further, the embodiment of installing the reflected pattern-printed transparent sheet 1 onto the medium 5 may not be adhesion and may be super position (arrangement) on the medium, and it may be arranged, as described above, in a non-contact state.

The reflected pattern-printed transparent sheet 1 of the present invention is preferably separable in order to enhance convenience in the production thereof. To be specific, it includes the sheets which can be separated by cutting tools such as scissors or dedicated cutting tools and the sheets which can be separated with hands by providing perforated lines or half cuts (means which are used in many cases in the field of packaging materials and in which a cut line having such a depth that does not reach a whole depth is provided in a thickness direction). Such sheets can be cut by users according to a size of the medium 5 owned by the respective users, and therefore the makers suitably produce the sheets set to several kinds of prescribed sizes. Further, cut lines corresponding to the standard sizes of general purpose display devices may be provided.

If the ways of use described above are possible, one sheet on which patterns providing position informations are printed can be divided so that the respective sheets show different coordinate ranges. When the above sheets are used, the sheet showing a continuous coordinate is applied to, for example, an adjacent medium, whereby input data can be provided with continuity. Further, plural transparent sheets 1 having different coordinate ranges are used for one input device while switching the sheets over, whereby different meanings can be given to the respective transparent sheets 1.

EXAMPLES

Next, the present invention shall be explained in further details with reference to examples, but the present invention shall not be restricted to the examples shown below.

Example 1

A monomer (having a molecular structure shown by the chemical formula (9) described above) 100 mass parts which had a polymerizable acryloyl group at an end and in which a nematic-isotropic transfer temperature was in the vicinity of 110° C., a chiral agent (having a molecular structure shown by the chemical formula (12) described above) 3.0 mass parts which had a polymerizable acryloyl group at an end and a photopolymerization initiator diphenyl-(2,4,6-trimethylbenzoyl)phosphine oxide (trade name: Lucirin TPO, manufactured by BASF Japan Ltd.) 4 mass parts were dissolved in MIBK (methyl isobutyl ketone) to prepare a solution, and this was used as a liquid crystal ink.

On the other hand, a solution prepared by dissolving 100 mass parts of pentaerythritol triacrylate, 0.03 mass part of an acrylic acid copolymer base leveling agent (trade name: BYK361, manufactured by BYK Chemie AG.) and 4 mass parts of a polymerization initiator (trade name: Lucirin TPO, manufactured by BASF J AG.) in MEK (methyl ethyl ketone) was coated on a PET substrate having a thickness of 125 μm by a bar coater and dried at 80° C. for 2 minutes to form a primer layer having a film thickness of 1 μm, whereby a transparent substrate was prepared.

The liquid crystal ink was coated on the primer layer of the above transparent substrate by the gravure printing method so that dot forms were prepared, and the dots were oriented so that they assumed a cholesteric structure. Then, the liquid crystal ink was cured by cross-linking reaction by irradiation with a UV ray to obtain a reflected pattern-printed transparent sheet. The transparent sheet thus obtained was measured for a reflectance of a rectangular pattern (solid coated part) for measuring a reflectance by means of a spectrophotometer (incident angle: 5°, manufactured by Shimadzu Corporation) to find that a selective reflection wavelength of the coating film of the transparent patterns in an infrared ray was 850 nm and that the reflectance was 20%.

Further, a thickness of a dot part in the transparent patterns was measured to find that it was 8 μm, and a cross section obtained by cutting the dot part in a face orthogonal to the transparent substrate was observed under a scanning electron microscope to find that the dot part was formed, as shown in FIG. 5, so that it comprised a multilayer structure comprising a fixed repeating cycle. The above reflected pattern-printed transparent sheet was used to evaluate reading by means of a pen type sensor which reflected an infrared ray to detect a reflected light thereof in the form of an image to find that the reading was made at a satisfactory signal level without causing impossibility of reading and errors in recognition of position informations (coordinates) and that it was very good.

Example 2

A monomer (having a molecular structure shown by the chemical formula (9) described above) 100 mass parts which had a polymerizable acryloyl group at an end and in which a nematic-isotropic transfer temperature was in the vicinity of 110° C., a chiral agent (having a molecular structure shown by the chemical formula (12) described above) 9.0 mass parts which had a polymerizable acryloyl group at an end and a photopolymerization initiator diphenyl-(2,4,6-trimethylbenzoyl)phosphine oxide (trade name: Lucirin TPO, manufactured by BASF Japan Ltd.) 4 mass parts were dissolved in cyclohexanone to prepare a solution, and this was used as a liquid crystal ink.

On the other hand, a solution prepared by dissolving 100 mass parts of pentaerythritol triacrylate, 0.03 mass part of an acrylic acid copolymer base leveling agent (trade name: BYK361, manufactured by BYK Chemie AG.) and 4 mass parts of a polymerization initiator (trade name: Lucirin TPO, manufactured by BASF J AG.) in cyclohexanone was coated on a PET substrate having a thickness of 125 μm by a bar coater and dried at 80° C. for 2 minutes to form a primer layer having a film thickness of 1 μm, whereby a transparent substrate was prepared.

The liquid crystal ink was coated on the primer layer of the above transparent substrate by the gravure printing method so that dot forms were prepared, and the dots were oriented so that they assumed a cholesteric structure. Then, the liquid crystal ink was cured by cross-linking reaction by irradiation with a UV ray to obtain a reflected pattern-printed transparent sheet. The transparent sheet thus obtained was measured for a reflectance of a rectangular pattern (solid coated part) for measuring a reflectance by means of a spectrophotometer (incident angle: 5°, manufactured by Shimadzu Corporation) to find that a selective reflection wavelength of the coating film of the transparent patterns in a UV ray was 300 nm and that the reflectance was 20%.

Further, a thickness of a dot part in the transparent patterns was measured to find that it was 8 μm, and a cross section obtained by cutting the dot part in a face orthogonal to the transparent substrate was observed under a scanning electron microscope to find that the dot part was formed, as shown in FIG. 5, so that it comprised a multilayer structure comprising a fixed repeating cycle. The above reflected pattern-printed transparent sheet was used to evaluate reading by means of a pen type sensor which reflected a UV ray to detect a reflected light thereof in the form of an image to find that the reading was made at a satisfactory signal level without causing impossibility of reading and errors in recognition of position informations (coordinates) and that it was very good.

Comparative Example 1

A reflected pattern-printed transparent sheet was prepared in the same manner as in Example 1, except that the liquid crystal was coated directly on the PET substrate having a thickness of 125 μm without providing the primer layer. The transparent sheet thus obtained was measured for a reflectance of a rectangular pattern (solid coated part) for measuring a reflectance in the same manner as in Example 1 to find that a selective reflection wavelength of the coating film was 850 nm and that the reflectance was 5%.

In the above case, a thickness of the dot part was 3 μm. Reading was evaluated in the same manner as in Example 1 by means of the pen type sensor to find that an intensity of the infrared reflected light was low as compared with Example 1 and that the reading level measured by means of the pen type sensor was low.

Comparative Example 2

A reflected pattern-printed transparent sheet was prepared in the same manner as in Example 1, except that the leveling agent was not added to the primer layer formed on the PET substrate having a thickness of 125 μm. The transparent sheet thus obtained was measured for a reflectance of a rectangular pattern (solid coated part) for measuring a reflectance in the same manner as in Example 1 to find that a selective reflection wavelength of the coating film was 850 nm and that the reflectance was 2%.

In the above case, a thickness of the dot part was 1 μm. Reading was evaluated in the same manner as in Example 1 by means of the pen type sensor to find that an intensity of the infrared reflected light was further low as compared with Comparative Example 1 and that the reading level measured by means of the pen type sensor was further low.

Comparative Example 3

A reflected pattern-printed transparent sheet was prepared in the same manner as in Example 2, except that the liquid crystal was coated directly on the PET substrate having a thickness of 125 μm without providing the primer layer. The transparent sheet thus obtained was measured for a reflectance of a rectangular pattern (solid coated part) for measuring a reflectance in the same manner as in Example 2 to find that a selective reflection wavelength of the coating film was 300 nm and that the reflectance was 2%.

In the above case, a thickness of the dot part was 3 μm. Reading was evaluated in the same manner as in Example 1 by means of the pen type sensor to find that an intensity of the infrared reflected light was low as compared with Example 2 and that the reading level measured by means of the pen type sensor was low.

Comparative Example 4

A reflected pattern-printed transparent sheet was prepared in the same manner as in Example 2, except that the leveling agent was not added to the primer layer formed on the PET substrate having a thickness of 125 μm. The transparent sheet thus obtained was measured for a reflectance of a rectangular pattern (solid coated part) for measuring a reflectance in the same manner as in Example 2 to find that a selective reflection wavelength of the coating film was 300 nm and that the reflectance was 1%.

In the above case, a thickness of the dot part was 1 μm. Reading was evaluated in the same manner as in Example 2 by means of the pen type sensor to find that an intensity of the infrared reflected light was further low as compared with Comparative Example 3 and that the reading level measured by means of the pen type sensor was further low.

INDUSTRIAL APPLICABILITY

As explained above in details, the reflected pattern-printed transparent sheet of the present invention is a member which can be applied not only to a data input system of a type in which data are handwritten directly on a picture plane of the medium but also data input systems of various manners and which provides a coordinate detecting means. Since a high non-visible light reflection intensity and a high transparency are obtained, it has high practical performances and can be used for various information processing devices including cellular phones, various mobile terminals such as PDA and the like, personal computers, TV phones, TV endowed with an intercommunication function, internet terminals and the like.

What is claimed is:

1. A reflected pattern-printed transparent sheet in which non-visible light reflective dot shaped transparent patterns are printed on a surface of a transparent substrate and which is mounted oppositely to a front face of a medium capable of displaying images, wherein an ink forming the dot shaped transparent patterns described above contains a non-visible light reflection material; the non-visible light reflection material is a material having a wavelength selection reflectivity to a wavelength in a non-visible light region; and a thickness of the above dot shaped transparent patterns is 6 to 20 μm;

wherein the transparent substrate comprises a base material and a primer layer containing a liquid repellent leveling agent, and the dot shaped transparent patterns are printed on the surface of the primer layer;

wherein the liquid repellent leveling agent is an acrylic acid copolymer base, wherein when a cross section obtained by cutting the dot shaped transparent patterns in a face orthogonal to the transparent substrate is observed under a scanning electron microscope, the dot shaped transparent patterns are formed so that they comprise a multilayer structure comprising a fixed repeating cycle; and wherein the multilayer structure is formed from a liquid crystal material having a fixed cholesteric structure.

2. The reflected pattern-printed transparent sheet as described in claim 1, wherein the dot shaped transparent patterns reflect either of a left circularly polarized light component and a right circularly polarized light component in an incident light.

3. The reflected pattern-printed transparent sheet as described in claim 1, wherein the dot shaped transparent patterns described above are patterns in which reflected patterns of a non-visible light are read by an input terminal capable of irradiation and detection of a non-visible light and in which position information of the input terminal on the transparent sheet can be provided.

4. The reflected reflection pattern-printed transparent sheet as described in claim 1, wherein the liquid crystal material having a fixed cholesteric structure comprises a chiral nematic liquid crystal material prepared by mixing a nematic liquid crystal with a chiral agent.

5. The reflected reflection pattern-printed transparent sheet as described in claim 4, wherein the nematic liquid crystal and the chiral agent have respectively cross-linkable functional groups, and the cholesteric structure is fixed by cross-linking them.

6. The reflected reflection pattern-printed transparent sheet as described in claim 5, wherein the nematic liquid crystal and/or the chiral agent are compounds having an acrylate structure.

7. The reflected pattern-printed transparent sheet as described in claim 1, wherein the dot shaped transparent patterns have a selective reflection peak wavelength in 800 to 950 nm.

8. The reflected pattern-printed transparent sheet as described in claim 1, wherein the dot shaped transparent patterns have a selective reflection peak wavelength in 200 to 400 nm.

9. The reflected pattern-printed transparent sheet as described in claim 1, wherein the reflected pattern-printed transparent sheet is equipped with an installing device for installation thereof onto the medium.

10. The reflected pattern-printed transparent sheet as described in claim 9, wherein the installing device is an adhering instrument which is provided at a contact face side brought into contact with the medium and which has an adhesive property for adhering the instrument onto the medium.

11. The reflected pattern-printed transparent sheet as described in claim 1, wherein the base material to be used for the transparent substrate is selected from the group consisting of glass, triacetyl cellulose, polyethylene terephthalate, polycarbonate, polyvinyl chloride, acryl and polyolefin, and the reflection pattern-printed transparent sheet is separable.

* * * * *